US005699778A

United States Patent [19]

Muraguchi et al.

[11] Patent Number: 5,699,778

[45] Date of Patent: Dec. 23, 1997

[54] FUEL EVAPORATIVE EMISSION SUPPRESSING APPARATUS

[75] Inventors: Tomokazu Muraguchi; Takuya Matsumoto, both of Tokyo, Japan

[73] Assignee: Mitsubishi Jidosha Kogyo Kabushiki Kaisha, Tokyo, Japan

[21] Appl. No.: 693,328

[22] PCT Filed: Dec. 14, 1995

[86] PCT No.: PCT/JP95/02565

§ 371 Date: Aug. 15, 1996

§ 102(e) Date: Aug. 15, 1996

[87] PCT Pub. No.: WO96/18814

PCT Pub. Date: Jun. 20, 1996

[30] Foreign Application Priority Data

Dec. 15, 1994 [JP] Japan ..... 6-312152

[51] Int. Cl.[6] ..... F02M 25/08; F02D 41/14

[52] U.S. Cl. ..... 123/698; 123/520

[58] Field of Search ..... 123/518, 519, 123/520, 698, 674

[56] References Cited

U.S. PATENT DOCUMENTS

| | | | |
|---|---|---|---|
| 4,967,713 | 11/1990 | Kojima | 123/518 |
| 5,020,503 | 6/1991 | Kanasashi | 123/519 |
| 5,351,193 | 9/1994 | Poirier et al. | 123/519 |
| 5,423,307 | 6/1995 | Okawa et al. | 123/698 |
| 5,469,832 | 11/1995 | Nemoto | 123/518 |
| 5,535,719 | 7/1996 | Morikawa et al. | 123/698 |

FOREIGN PATENT DOCUMENTS

| | | |
|---|---|---|
| 2-245442 | 10/1990 | Japan . |
| 4112959 | 4/1992 | Japan . |
| 4128546 | 4/1992 | Japan . |
| 4164148 | 6/1992 | Japan . |
| 5-321774 | 12/1993 | Japan . |

*Primary Examiner*—Thomas N. Moulis

[57] ABSTRACT

A fuel evaporative emission suppressing apparatus includes an electronic control unit (50) for executing a purge control subroutine wherein the driving duty factor of a purge control valve (46) for controlling the purge air flow rate is subjected to variable control. In the purge control subroutine, the electronic control unit compares the air-fuel ratio correction coefficient ($K_{IFB}$) calculated in an air-fuel ratio feedback control subroutine with a target air-fuel ratio correction coefficient ($K_{IOBJ}$) for purge air introduction period, increases or decreases a purge correction coefficient ($K_{PFB}$) in accordance with the comparison result, and actuates the purge control valve with a duty factor ($D_{PRG}$) obtained by multiplying a basic duty factor ($D_T$), retrieved from an engine rotational speed-volumetric efficiency map, by the purge correction coefficient. Consequently, the required quantity of purge air is supplied to the engine with a good response to a change in the engine operating state, without causing the air-fuel ratio to deviate from a proper range.

13 Claims, 7 Drawing Sheets

FUEL EVAPORATIVE EMISSION SUPPRESSING APPARATUS

TECHNICAL FIELD

The present invention relates to a fuel evaporative emission suppressing apparatus.

BACKGROUND ART

To prevent air pollution etc., the engine or vehicle body of an automobile is equipped with various devices for treating harmful emissions. Examples of such devices known in the art include a blow-by gas recirculating apparatus for introducing blow-by gas, which is a gas that leaks from a combustion chamber of the engine to a crankcase and contains unburned fuel component (HC) as its main component, into the intake pipe, and a fuel evaporative emission suppressing apparatus for introducing evaporative fuel gas, which is produced in a fuel tank and contains HC as its main component, into the intake pipe.

The fuel evaporative emission suppressing apparatus comprises a canister filled with activated charcoal for adsorbing evaporative fuel gas, a large number of pipes, etc. The canister has an inlet port communicating with the fuel tank, an outlet port communicating with the intake pipe, and a vent port opening to the atmosphere. In this canister storage-type fuel evaporative emission suppressing apparatus, the evaporative fuel gas in the fuel tank is introduced into the canister so as to be adsorbed by the activated charcoal. By allowing the negative pressure in the intake pipe to act upon the outlet port, the atmospheric air (purge air) is introduced into the canister through the vent port, so that the evaporative fuel gas adsorbed by the activated charcoal is separated therefrom by the purge air and then introduced into the intake pipe together with the purge air. The evaporative fuel gas thus introduced into the intake pipe burns together with air-fuel mixture in the combustion chamber of the engine, thus preventing the emission of evaporative fuel gas into the atmosphere.

If, however, the purge air containing evaporative fuel gas is inappropriately introduced into the intake pipe, the air-fuel ratio of a mixture deviates from a proper range, causing large fluctuation of the rotational speed or torque of the engine. As a result, the ride quality or drivability of the vehicle deteriorates. This disadvantage is noticeable particularly in the case where the purge air is introduced while the engine is operated in an idling region in which the quantity of intake air is small.

To eliminate the disadvantage, a purge control valve, as purge adjusting means for controlling the quantity of purge air to be introduced, is arranged in a purge passage connecting the canister and the intake pipe, and is opened to introduce the purge air into the engine only when the engine is operated in a predetermined operating region. Purge control valves are generally classified into a mechanical type which is responsive to the intake negative pressure, and an electric type which is subjected to on-off control by an electronic control unit in accordance with operation information such as throttle opening degree, intake air flow rate and the like. The mechanical type is inexpensive and thus is widely used, but from the viewpoint of performance, the electromagnetic type is superior because the introduction and cutoff of purge air can be accurately controlled as desired.

However, the fuel evaporative emission suppressing apparatus equipped with such purge control valve still has a problem associated with the introduction of purge air. For example, if the vehicle is parked for a long time in the summertime or the like in which the outside air temperature is high, a large quantity of evaporative fuel gas is produced within the fuel tank and adsorbed by the canister. In this case, as soon as the engine operation enters the predetermined operating region after the start of the engine, purge air having a very high content of evaporative fuel gas is supplied to the engine, making the air-fuel mixture extremely enriched. As the engine operation in the predetermined operating region is continued, separation of the evaporative fuel gas progresses in the canister, and thus the concentration of the fuel component in the purge air gradually decreases. In this case, if the quantity of fuel which has been reduced by a value corresponding to the quantity of the fuel component supplied from the canister to the engine at the initial stage of introduction of the purge air is continuously supplied to the engine from a fuel system, the air-fuel mixture becomes excessively lean as the introduction of purge air continues.

Thus, the concentration of the fuel component in the purge air varies depending on the engine operating state. In an apparatus wherein the purge air is introduced into the engine at a constant flow rate, therefore, there are restrictions on the flow rate of purge air, because the air-fuel ratio of the mixture must be prevented from deviating from the proper range. Consequently, it is difficult to promptly separate the fuel component adsorbed by the canister.

To eliminate the drawback, apparatuses for controlling the flow rate of purge air have been proposed, as disclosed in Japanese laid-open Patent No. H4-112959, No. H4-128546 and No. H4-164148.

Japanese laid-open Patent No. H4-112959 discloses an apparatus for controlling evaporative fuel treatment wherein the flow rate of purge air is variably controlled in accordance with the concentration of evaporative fuel. Specifically, this apparatus obtains an actual fuel injection quantity TAU ($=t-(KPG\times N_{E0}/N_E)$) by subtracting a quantity obtained by multiplying a purge correction quantity KPG by the ratio of an engine idle speed to a current engine rotational speed, from a fuel injection quantity t ($=T_P\times FAF\times K$) obtained by multiplying a basic fuel injection quantity $T_P$, calculated based on an intake air quantity Q and an engine rotational speed $N_E$, by the product of a feedback correction coefficient FAF and a constant K. While a purge execution condition is fulfilled, the apparatus cyclically executes a routine for setting the purge correction quantity KPG and a routine for setting a duty factor DPG of the purge control valve.

In the purge correction quantity KPG setting routine, the purge correction quantity KPG is decreased by a first fixed value per cycle if an average value $FAF_{av}$ of the feedback correction coefficient (evaporative fuel concentration) is greater than an upper limit value, and is increased by a second fixed value per cycle if the average value $FAF_{av}$ is smaller than a lower limit value. In the duty factor DPG setting routine, the duty factor DPG is decreased by a constant value per cycle if the average value $FAF_{av}$ is greater than the upper limit value, and is increased by the constant value per cycle if the average value $FAF_{av}$ is smaller than the lower limit value.

Japanese laid-open Patent No. H4-128546 discloses a fuel vapor purge control apparatus for controlling the flow rate of purge air by means of a flow control valve arranged in a purge passage. This apparatus is designed to prevent the excessive introduction of purge air in the case where the flow control valve is kept open due to fault.

More specifically, this apparatus has a fuel vapor passage provided with flow rate control means (e.g., duty-controlled solenoid valve) which is controlled by an air-fuel ratio feedback controller, and this fuel vapor passage diverges into first and second branch passages at a location downstream of the flow rate control means. The first branch passage communicates with the intake passage through a first port. When the opening degree of the throttle valve is smaller than or equal to an idle opening degree, the first port is situated on the upstream side of the throttle valve. Accordingly, during idling, no intake negative pressure acts upon a check valve arranged in the first branch passage; therefore, the check valve is closed and the fuel vapor purge via the first branch passage is not carried out. Consequently, even in the case where the flow control solenoid valve is kept open due to fault, during idling operation, fuel vapor is purged only through the second branch passage communicating with the intake passage via a second port provided on the downstream side of the throttle valve, whereby the excessive introduction of purge air is prevented. When the opening degree of the throttle valve is larger than the idle opening degree, the first port is situated on the downstream side of the throttle valve; therefore, the check valve opens and fuel vapor is purged into the intake passage through the first and second branch passages.

Japanese laid-open Patent No. H4-164148 discloses a fuel vapor purge control apparatus similar to the apparatus disclosed in Japanese laid-open Patent No. H4-128546. This apparatus has first and second purge passages. The first purge passage communicates with the intake passage through a port which is provided so as to be located on an upstream side of the throttle valve when the throttle valve opening degree is smaller than or equal to the idle opening degree. Also, the first purge passage is provided with a check valve. The second purge passage includes a large-flow branch passage, a small-flow branch passage, and a single-flow passage. The two branch passages are arranged parallel to each other and one of these branch passages is selected by a directional control valve arranged at the junction of the branch passages. The single-flow passage, which is arranged in series with the branch passages, is provided with a flow control valve (e.g., a duty-controlled solenoid valve) which is controlled by an air-fuel ratio feedback controller.

When the throttle valve opening degree is smaller than or equal to the idle opening degree, this apparatus closes the check valve arranged in the first purge passage, selects the large- or small-flow branch passage in accordance with the intake air pressure, and periodically executes a control routine for controlling the duty factor of the flow control valve.

More specifically, in this duty control routine, while a purge condition is fulfilled and the air-fuel ratio feedback control is under execution, the duty factor is incremented by a predetermined value a per cycle if an average FAF of the feedback correction value is greater than a predetermined value (e.g., 0.9), and is decremented by the predetermined value a per cycle if the average value FAF is smaller than the predetermined value. In this manner, the ratio of the purge flow rate to the fuel injection quantity is controlled to a predetermined value (e.g., 10%).

During idling, the check valve of the first purge passage is closed as mentioned above, so that evaporative fuel gas is purged only through the second purge passage. Accordingly, even in the event the flow control valve becomes faulty and is kept open, no excessive purge air is introduced during idling. On the other hand, when the throttle valve opening degree is greater than the idle opening degree, evaporative fuel gas is purged into the intake passage through both the first and second purge passages. In the event the flow control valve becomes faulty and is kept closed, evaporative fuel gas is purged through the first purge passage.

As described above, in the apparatus disclosed in Japanese laid-open Patent No. H4-112959, the duty factor DPG of the purge control valve (purge air flow rate) is increased or decreased by a fixed value per cycle as needed. In the apparatus disclosed in Japanese laid-open Patent No. H4-164148, on the other hand, the duty factor of the flow control valve (purge air flow rate) is increased or decreased by the predetermined value a per cycle as needed.

However, such conventional technique of increasing and decreasing the opening degree of the flow control valve by a fixed value entails a drawback that a difficulty is encountered in appropriately and variably controlling the purge air flow rate. Specifically, if the amount by which the opening degree of the flow control valve is varied at a time is too large, the valve opening degree (purge air flow rate) having been varied to achieve a proper purge air flow rate can be excessively large or small in an engine operating region in which the purge air flow rate is small, for example, in a low-speed region. In such cases, the valve opening degree is restored to the previous opening degree which, however, is an improper opening degree, thus causing hunting of the opening/closing operation of the flow control valve. Therefore, the amount by which the valve opening degree is varied at a time must be reduced, which results in a reduction in the amount by which the purge air flow rate varies in response to a single change of the valve opening degree. Thus, in cases where the engine operating region shifts between a low-speed region and a medium/high-speed region and the intake air quantity suddenly increases or decreases, for example, it is necessary that the valve opening degree be varied a large number of times. Namely, the response (follow-up ability) of the change of the purge air flow rate to a change in the engine operating state deteriorates. In order to enhance the response, the execution interval of the routine for setting the opening degree (duty factor) of the flow control valve may be shortened. If, however, the execution interval of this routine is shorter than that of the air-fuel ratio feedback control, fluctuation of the air-fuel ratio attributable to the introduction of purge air containing fuel components cannot be suppressed by means of the air-fuel ratio feedback control, with the result that the air-fuel ratio cannot be controlled to a value falling within a proper range.

In conclusion, where the conventional fuel evaporative emission suppressing apparatus by which the opening degree of the flow control valve is increased/decreased by a fixed amount is installed in an automotive engine whose operating state frequently changes, it is difficult to achieve proper purge air introduction.

To mitigate the inconvenience, a dual purge passage system may be employed, in which case, however, the arrangement of the apparatus becomes complicated and the cost increases.

DISCLOSURE OF THE INVENTION

An object of the present invention is to provide a fuel evaporative emission suppressing apparatus capable of introducing purge air into an internal combustion engine with a good response with respect to a change in the operating state of the engine, while at the same time keeping the air-fuel ratio of a mixture at a value falling within a proper range.

According to the present invention, there is provided a fuel evaporative emission suppressing apparatus for an internal combustion engine whose operation is controlled by fuel supply control means which uses an air-fuel ratio correction coefficient to set the quantity of fuel to be supplied from fuel supply means to the internal combustion engine during air-fuel ratio feedback control in which the air-fuel ratio of a mixture supplied to the internal combustion engine is controlled to a target air-fuel ratio. This apparatus has adsorbing means for adsorbing evaporative fuel gas introduced from a fuel supply system, and purge adjusting means for controlling the quantity of introduction of purge air, which contains outside air and evaporative fuel gas separated from the adsorbing means, into an intake passage of the internal combustion engine.

A fuel evaporative emission suppressing apparatus according to a first aspect of the invention comprises operating state detecting means for detecting an operating state of the internal combustion engine; target air-fuel ratio correction coefficient setting means for setting a target air-fuel ratio correction coefficient for purge air introduction period; purge correction variable setting means for comparing the target air-fuel ratio correction coefficient with an air-fuel ratio correction coefficient which is set by the fuel supply control means during introduction of purge air, and for variably setting a purge correction variable in accordance with the comparison result and the engine operating state detected by the operating state detecting means; basic purge control variable setting means for setting a basic purge control variable in accordance with the engine operating state detected by the operating state detecting means; and purge control means for obtaining a purge control variable based on the purge correction variable and the basic purge control variable, and controlling operation of the purge adjusting means in accordance with the purge control variable.

The apparatus according to the first aspect of the invention is advantageous in that, during introduction of purge air, the purge control variable is obtained such that the air-fuel ratio correction coefficient for determining the quantity of supplied fuel becomes equal to the target air-fuel ratio correction coefficient for purge air introduction period. This permits purge air to be introduced into the engine while at the same time keeping the air-fuel ratio of a mixture at a value falling within a proper range. Also, the ratio of the quantity of evaporative fuel gas supplied as a result of the introduction of purge air to the quantity of fuel supplied from the fuel supply means can be made equal to a target ratio. In other words, a required quantity or a large quantity of purge air can be introduced.

Another advantage of the present invention is that a quantity of purge air suited to the engine operating state can be introduced by setting the basic purge control variable for the purge control variable, which determines the quantity of purge air to be introduced, in accordance with the engine operating state. Thus, when the engine operating state has changed, the quantity of purge air introduced can be properly and quickly varied. That is, the introduction of purge air according to the present invention ensures an excellent response (follow-up ability) to a change in the engine operating state. Further, since the purge correction variable is variably set in accordance with the engine operating state in such a manner that the air-fuel ratio correction coefficient becomes equal to the target air-fuel ratio correction coefficient for purge air introduction period, the air-fuel ratio can be kept at a value falling within a proper range during the introduction of purge air.

Furthermore, in the apparatus according to the first aspect of the invention, the purge control variable is obtained based on the purge correction variable and the basic purge control variable; therefore, it is possible to simultaneously accomplish the improvement of the response through the setting of the basic purge control variable in accordance with the engine operating state, and the optimization of the air-fuel ratio through the variable setting of the purge correction variable. Namely, even when the engine operating state greatly changes, the quantity of purge air to be introduced can be properly and quickly varied. In other words, it is possible to optimize the amount by which the purge air to be introduced is varied in response to a change in the engine operating state. Consequently, even in a transitional engine operating condition, purge air can be promptly introduced such that the ratio of the quantity of introduced evaporative fuel gas to the quantity of supplied fuel is constant, thus optimizing the quantity of purge air introduced. This prevents the air-fuel ratio from becoming excessively rich or lean due to deficiency or excess of the purge air introduced.

A fuel evaporative emission suppressing apparatus according to a second aspect of the invention comprises operating state detecting means for detecting an operating state of the internal combustion engine; target air-fuel ratio correction coefficient setting means for setting a target air-fuel ratio correction coefficient for purge air introduction period; purge correction variable setting means for comparing the target air-fuel ratio correction coefficient with an air-fuel ratio correction coefficient which is set by the fuel supply control means during introduction of purge air, and for setting a purge correction variable in accordance with the comparison result; purge correction variable modifying means for modifying the purge correction variable in accordance with a change in the engine operating state in such a manner that fluctuation of the air-fuel ratio is suppressed; basic purge control variable setting means for setting a basic purge control variable in accordance with the engine operating state detected by the operating state detecting means; and purge control means for obtaining a purge control variable based on the purge correction variable modified by the purge correction variable modifying means and the basic purge control variable, and for controlling operation of the purge adjusting means in accordance with the purge control variable.

The apparatus according to the second aspect of the invention provides advantages similar to those achieved by the apparatus according to the first aspect of the invention. Namely, purge air can be introduced into the engine while keeping the air-fuel ratio of the mixture at a value falling within a proper range. Also, the ratio of the quantity of introduced evaporative fuel gas to the quantity of supplied fuel can be made equal to the target ratio. Further, the quantity of purge air to be introduced can be properly and promptly varied in response to a change in the engine operating state.

In the apparatus according to the second aspect of the invention, the purge correction variable is modified in accordance with the engine operating state so as to suppress fluctuation of the air-fuel ratio, and the purge control variable is obtained based on the thus-modified purge correction variable and the basic purge control variable; therefore, both the improvement of the response through the setting of the basic purge control variable in accordance with the engine operating state and the optimization of the air-fuel ratio through the setting and modification of the purge correction variable can be simultaneously achieved. Namely, as in the apparatus according to the first aspect of the invention, the quantity of purge air to be introduced can be properly and promptly varied even when the engine operating state greatly changes, thereby preventing the air-fuel ratio from becoming excessively rich or lean due to the introduction of purge air.

A fuel evaporative emission suppressing apparatus according to a third aspect of the invention comprises operating state detecting means for detecting an operating state of the internal combustion engine; target air-fuel ratio correction coefficient setting means for setting a target air-fuel ratio correction coefficient for purge air introduction period; purge correction coefficient setting means for comparing the target air-fuel ratio correction coefficient with an air-fuel ratio correction coefficient which is set by the fuel supply control means during introduction of purge air, and for setting a purge correction coefficient in accordance with the comparison result; basic purge control variable setting means for setting a basic purge control variable in accordance with the engine operating state detected by the operating state detecting means: and purge control means for obtaining a purge control variable by multiplying the basic purge control variable by the purge correction coefficient, and for controlling operation of the purge adjusting means in accordance with the purge control variable.

The apparatus according to the third aspect of the invention provides advantages similar to those achieved by the apparatuses according to the first and second aspects of the invention. Namely, purge air can be introduced into the engine while keeping the air-fuel ratio of the mixture at a value falling within a proper range, and also the ratio of the quantity of introduced evaporative fuel gas to the quantity of supplied fuel can be controlled to the target ratio. Further, the quantity of purge air to be introduced can be properly and promptly varied in response to a change in the engine operating state.

In the apparatus according to the third aspect of the invention, the purge control variable is obtained by multiplying the basic purge control variable by the purge correction coefficient; therefore, both the improvement of the response through the setting of the basic purge control variable in accordance with the engine operating state and the optimization of the air-fuel ratio through the setting of the purge correction coefficient can be simultaneously achieved. Namely, as in the apparatuses according to the first and second aspects of the invention, the quantity of purge air to be introduced can be properly and promptly varied even when the engine operating state greatly changes, thereby preventing the air-fuel ratio from becoming excessively rich or lean due to the introduction of purge air.

A fuel evaporative emission suppressing apparatus according to a fourth aspect of the invention comprises operating state detecting means for detecting an operating state of the internal combustion engine; target air-fuel ratio correction coefficient setting means for setting a target air-fuel ratio correction coefficient for purge air introduction period; purge correction coefficient setting means for comparing the target air-fuel ratio correction coefficient with an air-fuel ratio correction coefficient which is set by the fuel supply control means during introduction of purge air, and for setting a purge correction coefficient in accordance with the comparison result; basic purge control variable setting means for setting a basic purge control variable in accordance with the engine operating state detected by the operating state detecting means; and purge control means for obtaining a purge control variable based on a purge correction variable, which is obtained by multiplying the basic purge control variable by the purge correction coefficient, and the basic purge control variable, and for controlling operation of the purge adjusting means in accordance with the purge control variable.

The apparatus according to the fourth aspect of the invention provides advantages similar to those achieved by the apparatuses according to the first to third aspects of the invention. Namely, purge air can be introduced into the engine while keeping the air-fuel ratio of the mixture at a value falling within a proper range, the ratio of the quantity of introduced evaporative fuel gas to the quantity of supplied fuel can be controlled to the target ratio, and also, the quantity of purge air to be introduced can be properly and promptly varied in response to a change in the engine operating state.

In the apparatus according to the fourth aspect of the invention, the purge control variable is obtained based on the purge correction variable, which is obtained by multiplying the basic purge control variable by the purge correction coefficient, and the basic purge control variable; therefore, both the improvement of the response through the setting of the basic purge control variable in accordance with the engine operating state and the optimization of the air-fuel ratio through the setting of the purge correction variable can be simultaneously achieved. Namely, as in the apparatuses according to the first to third aspects of the invention, the quantity of purge air to be introduced can be properly and promptly varied even when the engine operating state greatly changes, thereby preventing the air-fuel ratio from becoming excessively rich or lean due to the introduction of purge air.

In the apparatuses according to the first to fourth aspects of the invention, the target air-fuel ratio correction coefficient setting means preferably sets the target air-fuel ratio correction coefficient for purge air introduction period in accordance with the operating state of the internal combustion engine detected by the operating state detecting means. In this case, the target air-fuel ratio correction coefficient for purge air introduction period can be set to an appropriate value.

Preferably, in the apparatuses according to the first to fourth aspects of the invention, the fuel supply control means sets the air-fuel ratio correction coefficient at predetermined intervals while permitting updating of the air-fuel ratio correction coefficient, and the purge adjusting means is operated at intervals identical with the predetermined intervals. The apparatus according to the present invention ensures an excellent response of the change in the quantity of introduction of purge air with respect to a change in the engine operating state, as mentioned above. Accordingly, also in the case where the purge adjusting means is operated at the same intervals as those for setting the air-fuel ratio correction coefficient to adjust the quantity of purge air to be introduced, the required response can be attained. Where the intervals for operating the purge adjusting means are identical with the intervals for setting the air-fuel ratio correction coefficient, fluctuation of the air-fuel ratio can be suppressed by means of the air-fuel ratio feedback control even when the air-fuel ratio fluctuates due to the introduction of purge air. By contrast, according to the conventional technique having poor response in relation to the introduction of purge air, if the intervals for operating the purge adjusting means are shorter than the intervals for setting the air-fuel ratio correction coefficient in order to improve the response, fluctuation of the air-fuel ratio resulting from the introduction of purge air cannot be suppressed by the air-fuel ratio feedback control, with the result that the air-fuel ratio deviates from the proper range and the emission characteristics of the engine deteriorate.

Preferably, the fuel evaporative emission suppressing apparatuses according to the first to fourth aspects of the invention further comprise purge passage forming means having a single purge passage connecting the adsorbing means to the intake passage of the internal combustion engine, and the purge adjusting means is arranged in the single purge passage. In the apparatus according to the present invention, even when the engine operating state frequently changes, the purge adjusting means is operated in such a manner that a proper quantity of purge air is always introduced into the engine, as mentioned above. Therefore, it is not necessary to provide two or more purge passages in order to prevent improper introduction of purge air attributable to a change in the engine operating state, and a single purge passage suffices. Accordingly, the apparatus can be simplified in arrangement and its cost is reduced.

Preferably, in the apparatuses according to the second to fourth aspects of the invention, the target air-fuel ratio correction coefficient setting means sets the target air-fuel ratio correction coefficient for purge air introduction period to a value such that a quantity of fuel supplied by the fuel supply means which corresponds to the target air-fuel ratio correction coefficient is smaller than a quantity of supplied fuel corresponding to an air-fuel ratio correction coefficient which is set during a non-purge air introduction period. The purge correction coefficient setting means or the purge correction variable setting means decreases the purge correction coefficient or the purge correction variable by a first predetermined gain when the air-fuel ratio correction coefficient is set to a value such that the quantity of supplied fuel is even smaller than the quantity of supplied fuel corresponding to the target air-fuel ratio correction coefficient. The purge correction coefficient setting means or the purge correction variable setting means increases the purge correction coefficient or the purge correction variable by a second predetermined gain when the air-fuel ratio correction coefficient is set to a value such that the quantity of supplied fuel is larger than the quantity of supplied fuel corresponding to the target air-fuel ratio correction coefficient.

In the fuel evaporative emission suppressing apparatus according to this preferred aspect of the invention, the quantity of purge air introduced into the engine is controlled in such a manner that the ratio of the quantity of evaporative fuel gas contained in the purge air to the quantity of supplied fuel is equal to the ratio of the target air-fuel ratio correction coefficient to the air-fuel ratio correction coefficient for non-purge air introduction period. Accordingly, it is possible to introduce the required quantity of purge air into the engine while keeping the air-fuel ratio of the mixture at a value falling within the proper range.

Also, in the apparatus according to the preferred aspect of the invention, the purge correction coefficient or the purge correction variable is decreased when the air-fuel ratio correction coefficient which is set during introduction of purge air is smaller than the target air-fuel ratio correction coefficient, and is increased when the former is larger than the latter. In the apparatus according to the third aspect of the invention, for example, the purge control variable is obtained by multiplying the basic purge control variable by the purge correction coefficient which has been increased or decreased so that the air-fuel ratio correction coefficient may be equal to the target value. As a result, purge air is promptly introduced with respect to a change in the engine operating state even in a transitional engine operating condition, thereby preventing the air-fuel ratio from becoming excessively rich or lean due to the introduction of purge air. It is, therefore, possible to prevent the emission characteristics of the engine from deteriorating due to the introduction of purge air.

The following further describes advantages achieved by the apparatus according to the preferred aspect of the invention. It is here assumed that the engine is provided with the fuel evaporative emission suppressing apparatus according to the aforementioned preferred aspect of the invention in which the purge adjusting means comprises a duty-controlled solenoid valve, and that the engine operating state shifts from a first operating state in which the basic purge control variable is 10% in terms of duty factor of the solenoid valve to a second operating state in which the basic purge control variable is 50%. It is also assumed that in the first engine operating state, the value of the purge correction coefficient, for example, "1", was decreased by the first predetermined gain, for example, the value "0.1". In this case, the purge control variable is 9% (=10×(1−0.1)) in terms of duty factor. In other words, the ratio of correction of the purge control variable to the basic purge control variable in the first operating state is −10% (=(9−10)÷10×100). The purge control variable at the time of transition from the first to second engine operating state is 45% (=50×(1−0.1)) in terms of duty factor. Also, the ratio of correction of the purge control variable to the basic purge control variable in the second operating state is −10% (=(45−50)÷50×100). Namely, according to the present invention, the ratio of correction of the purge control variable to the basic purge control variable is constant or substantially constant, regardless of the engine operating state (magnitude of the basic purge control variable).

This feature of the present invention serves to improve the response of the introduction of purge air with respect to a change in the engine operating state in a transitional engine operating condition. Moreover, the quantity of introduced purge air is optimized so that the influence upon the air-fuel ratio caused by the introduction of purge air may be constant, whereby the air-fuel ratio is prevented from becoming excessively rich or lean due to the introduction of purge air.

By contrast, in the conventional apparatus in which the opening degree of the solenoid valve is increased or decreased by a fixed value (e.g., 1% in terms of duty factor), the duty factor of the solenoid valve in the first engine operating state is 9% (=10−1), and the correction ratio in terms of duty factor is −10% (=(9−10)÷10×100). The duty factor in the second engine operating state is 49% (=50−1), and the correction ratio in terms of duty factor is −2% (=(49−50)÷50×100). Thus, in a transitional engine operating condition, the duty factor correction ratio, and hence the influence upon the air-fuel ratio caused by the introduction of purge air, greatly changes, possibly the quantity of introduced purge air becomes improper. In the above example, the duty factor correction ratio sharply decreases at the time of transition from the first to second operating state, so that the quantity of introduced purge air becomes too large, making the air-fuel ratio excessively rich. In such cases, the emission characteristics of the engine deteriorate, and thus the quantity of emission such as NOx or HC increases.

In the apparatus according to the preferred aspect of the invention, preferably, the purge correction coefficient setting means or the purge correction variable setting means leaves the purge correction coefficient or the purge correction variable unchanged when an air-fuel ratio correction coefficient set during introduction of purge air is equal to the target air-fuel ratio correction coefficient. In the apparatus according to this preferred aspect of the invention, the quantity of purge air introduced is maintained insofar as the ratio of the quantity of introduced purge air to the quantity of introduced air-fuel mixture remains at the target ratio. Thus, it is possible to introduce with stability the required quantity of purge air into the engine while keeping the air-fuel ratio of the mixture at a value falling within the proper range.

BEST MODE OF CARRYING OUT THE INVENTION

A fuel evaporative emission suppressing apparatus according to a first embodiment of the present invention will be hereinafter described in detail.

Figure 1:
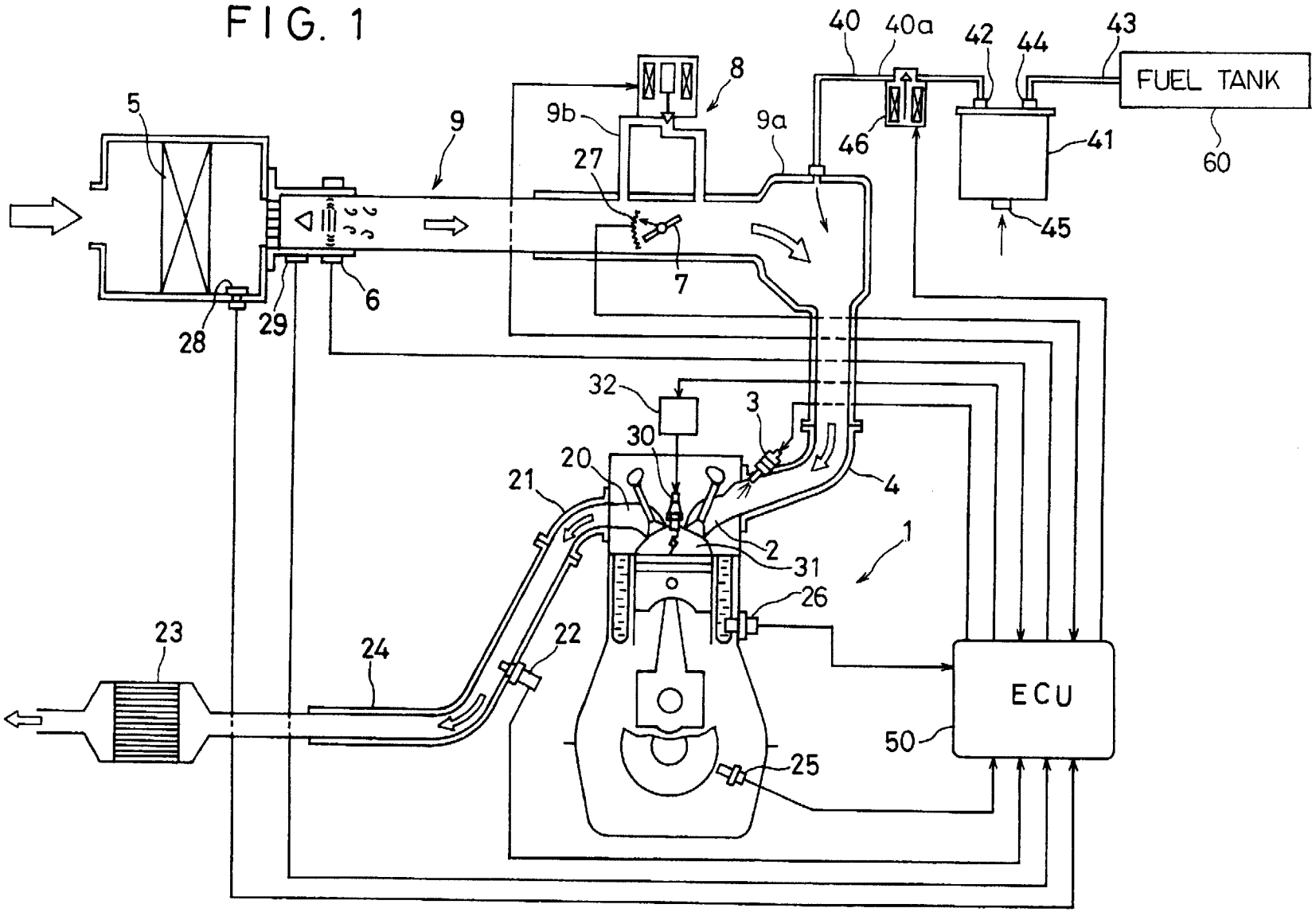
FIG. 1 is a schematic diagram showing the configuration of an engine control system equipped with a fuel evaporative emission suppressing apparatus according to a first embodiment of the present invention.

Referring to FIG. 1, reference numeral 1 denotes an automobile engine, for example, an in-line four-cylinder gasoline engine. The engine 1 has intake ports 2 connected to an intake manifold 4, which is provided with fuel injection valves 3 associated with the respective cylinders. An intake pipe 9, which is connected to the intake manifold 4 through a surge tank 9*a* for preventing intake air pulsation, is provided with an air cleaner 5 and a throttle valve 7. A bypass passage 9*b* bypassing the throttle valve 7 is provided with an idle speed control (ISC) valve 8 for controlling the quantity of air supplied to the engine 1 through the bypass passage 9*b*. The ISC valve 8 includes a valve member for increasing and decreasing the flow area of the bypass passage 9*b*, and a stepping motor for opening and closing the valve member.

Also, the engine 1 has exhaust ports 20 connected to an exhaust manifold 21, to which is connected a muffler, not shown, through an exhaust pipe 24 and a three-way catalyst 23. Reference numeral 30 denotes a respective spark plug for igniting a gaseous mixture of air and fuel supplied to a corresponding combustion chamber 31 from the intake port 2 associated therewith, and 32 denotes an ignition unit connected to the spark plugs 30.

The engine 1 is further equipped with a fuel evaporative emission suppressing apparatus for preventing the discharge of evaporative fuel gas produced in a fuel tank 60 (or more generally, a fuel supply system).

The fuel evaporative emission suppressing apparatus has a canister (adsorbing means) 41 filled with activated charcoal for adsorbing evaporative fuel gas. The canister 41 has formed therein a purge port 42 communicating with the surge tank 9*a* of the engine 1 through a purge pipe 40, an inlet port 44 communicating with the fuel tank 60 through an inlet pipe 43, and a vent port 45 opening to the atmosphere. The purge pipe (purge passage forming means) 40 has a single purge passage 40*a* which is provided with a purge control valve 46 as purge adjusting means.

The control valve 46 is a normally-closed solenoid valve including a valve member for opening and closing the purge pipe 40, a spring (not shown) for pushing the valve member in a direction to open the valve, and a solenoid electrically connected to an electronic control unit (ECU) 50. This control valve 46 is subjected to on-off control by the ECU 50 in such a manner that it opens when the solenoid is energized and is closed when the solenoid is de-energized.

When the control valve 46 is opened, intake negative pressure acts upon the purge port 42 to allow the atmospheric air to be introduced into the canister 41 from the vent port 45, and owing to the introduction of the atmospheric air, fuel components of evaporative fuel gas adsorbed to the canister 41 are separated therefrom and flow, together with the atmospheric air, into the surge tank 9*a* as purge air. When the control valve 46 is closed, the introduction of purge air is inhibited.

The fuel evaporative emission suppressing apparatus is provided with operating state detecting means for detecting the operating state of the engine 1. The operating state detecting means includes various sensors mentioned below, and most of these sensors are used also for ordinary engine operation control.

In FIG. 1, reference numeral 6 denotes a Karman vortex-type airflow sensor mounted on the intake pipe 9 for detecting the quantity of intake air; 22 denotes an $O_2$ sensor (air-fuel ratio detecting means) for detecting the concentration of oxygen in the exhaust gas flowing through the exhaust pipe 24; 25 denotes a crank angle sensor including an encoder interlocked with the camshaft of the engine 1 for generating a crank angle synchronization signal; 26 denotes a water temperature sensor for detecting the temperature $T_W$ of engine cooling water; and 27 denotes a throttle sensor for detecting the opening degree $q_{TH}$ of the throttle valve 7. Reference numeral 28 denotes an atmospheric pressure sensor for detecting the atmospheric pressure Pa, and 29 denotes an intake air temperature sensor for detecting the temperature Ta of intake air.

The fuel evaporative emission suppressing apparatus further includes the electronic control unit (ECU) 50 as its principal part. The ECU 50 includes input/output devices, storage devices (ROM, RAM, nonvolatile RAM, etc.) for storing various control programs and the like, a central processing unit (CPU), timers, (none of these are shown) etc. The input side of the ECU 50 is electrically connected to the aforementioned various sensors 6, 22 and 25 to 29, and the output side of the ECU 50 is electrically connected to the fuel injection valves 3, the stepping motor of the ISC valve 8, the solenoid of the control valve 46, etc.

The ECU 50 calculates an engine rotational speed $N_e$ based on the intervals of generation of the crank angle synchronization signals supplied from the crank angle sensor 25. Also, the ECU 50 calculates an intake air quantity (A/N) per suction stroke, based on the engine rotational speed and the output of the airflow sensor 60 and divides the thus-obtained intake air quantity (A/N) by a full-open A/N of an identical engine rotational speed, to obtain a volumetric efficiency equivalent value (hereinafter referred to as volumetric efficiency $E_v$). Further, the ECU 50 detects the operating state of the engine 1 based on the calculated engine rotational speed $N_e$, calculated intake air quantity (A/N), calculated volumetric efficiency $E_v$, the oxygen concentration of the exhaust gas detected by the $O_2$ sensor 22, and like data. Namely, the ECU 50 constitutes the operating state detecting means in cooperation with the various sensors 6, 22 and 25 to 29.

In accordance with the engine operating state thus determined, the ECU 50 (fuel supply control means) controls the quantity of fuel injected from the fuel injection valves 3 to the engine 1. In this fuel injection quantity control, the ECU 50 calculates a valve open time $T_{INJ}$ for the fuel injection valves 3 according to the equation below, and supplies each fuel injection valve 3 with a driving signal corresponding to the calculated valve open time $T_{INJ}$ to open the same, so that the required quantity of fuel is injected to each cylinder.

$$T_{INJ}=T_B\times K_{AF}\times K_{IA}+T_{DEAD}$$

where $T_B$ represents a basic injection quantity obtained based on the volumetric efficiency $E_v$, etc., and $K_{IA}$ represents the product ($K=K_{WT}, K_{AT}, \ldots$) of correction coefficients including a water temperature correction coefficient $K_{WT}$, an intake air temperature correction coefficient $K_{AT}$, etc. $K_{AF}$ represents an air-fuel ratio correction coefficient, and $T_{DEAD}$ represents a dead time correction value set in accordance with a battery voltage, etc.

When the engine 1 is operated in an air-fuel ratio feedback region, an air-fuel ratio feedback correction coefficient $K_{IFB}$ is calculated as the air-fuel ratio correction coefficient $K_{AF}$ according to the following equation:

$$K_{IFB}=1.0+P+I+I_{LRN}$$

where P represents a proportional correction value, I represents an integral correction value (integral correction coefficient), and $I_{LRN}$ represents a learning correction value.

The ECU 50 also controls the ignition timing of the spark plugs 30 by controlling the operation of the ignition unit 32. Further, the ECU 50 controls the operation of the stepping motor of the ISC valve 8 in accordance with the engine operating state, to thereby control the opening degree of the ISC valve 8. In this case, the ECU 50 calculates a deviation of the engine rotational speed from a target engine rotational speed and performs feedback control on the ISC valve 8 so that the deviation may fall within a predetermined range, whereby the engine rotational speed during idling is maintained substantially constant.

Figure 2:
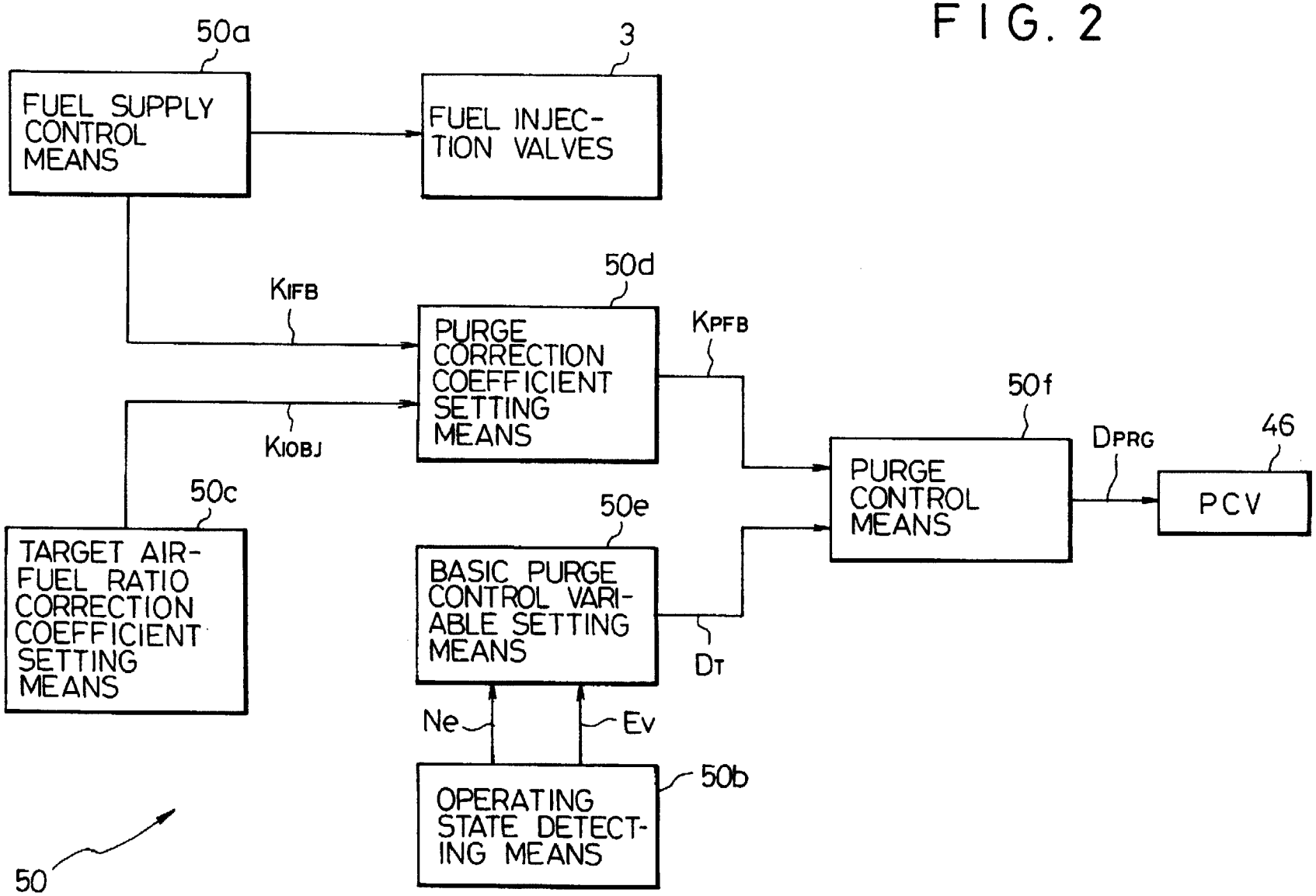
FIG. 2 is a schematic block diagram illustrating the function of an electronic control unit shown in FIG. 1.

Referring now to FIG. 2, the ECU 50 includes fuel supply control means 50*a* for setting the quantity of fuel to be supplied from the fuel injection valves (fuel supply means) 3 to the engine 1 during the air-fuel ratio feedback control, by using the air-fuel ratio correction coefficient $K_{IFB}$; operating state detecting means 50*b* for detecting the engine operating state in cooperation with the sensors 6, 22 and 25 to 29; and target air-fuel ratio correction coefficient setting means 50*c* for setting a target air-fuel ratio correction coefficient $K_{IOBJ}$ applied when the purge air is introduced. In this embodiment, the setting means 50*c* sets the target air-fuel ratio correction coefficient $K_{IOBJ}$ to a value such that the quantity of fuel supply from the fuel injection valves 3, which quantity corresponds to the correction coefficient $K_{IOBJ}$, is smaller than the quantity of supplied fuel corresponding to an air-fuel ratio correction coefficient which is set when no purge air is introduced. Also, the fuel supply control means 50*a* sets the air-fuel ratio correction coefficient $K_{IFB}$ at predetermined intervals while permitting updating of the same.

The ECU 50 further includes purge correction coefficient setting means 50*d* for comparing the target air-fuel ratio correction coefficient $K_{IOBJ}$ with the air-fuel ratio correction coefficient $K_{IFB}$ set by the fuel supply control means 50*a* during introduction of the purge air, to set a purge correction coefficient $K_{PFB}$ in accordance with the comparison result; basic purge control variable setting means 50*e* for setting a basic purge control variable $D_T$ based on the engine operating state detected by the operating state detecting means 50*b*; and purge control means 50*f* for obtaining a purge control variable $D_{PRG}$ by multiplying the basic purge control variable $D_T$ by the purge correction coefficient $K_{PFB}$, to thereby control the operation of the purge control valve (PCV) 46 as the purge adjusting means in accordance with the purge control variable $D_{PRG}$.

In this embodiment, the PCV 46 is actuated at intervals identical with those for setting the air-fuel ratio correction coefficient. When the air-fuel ratio correction coefficient $K_{IFB}$ is set to a value such that the quantity of supplied fuel is even smaller than the quantity of supplied fuel corresponding to the target air-fuel ratio correction coefficient $K_{IOBJ}$, the purge correction coefficient setting means 50*d* decreases the purge correction coefficient $K_{PFB}$ by a first predetermined gain $G_{PDN}$. When the air-fuel ratio correction coefficient $K_{IFB}$ is set to a value such that the quantity of supplied fuel is greater than the quantity of supplied fuel corresponding to the target air-fuel ratio correction coefficient $K_{IOBJ}$, the purge correction coefficient $K_{PFB}$ is increased by a second predetermined gain $G_{PUP}$, and when the air-fuel ratio correction coefficient $K_{IFB}$ is equal to the target air-fuel ratio correction coefficient $K_{IOBJ}$, the correction coefficient $K_{PFB}$ is left unchanged.

The operation of the fuel evaporative emission suppressing apparatus configured as described above will be now described.

Figure 3:
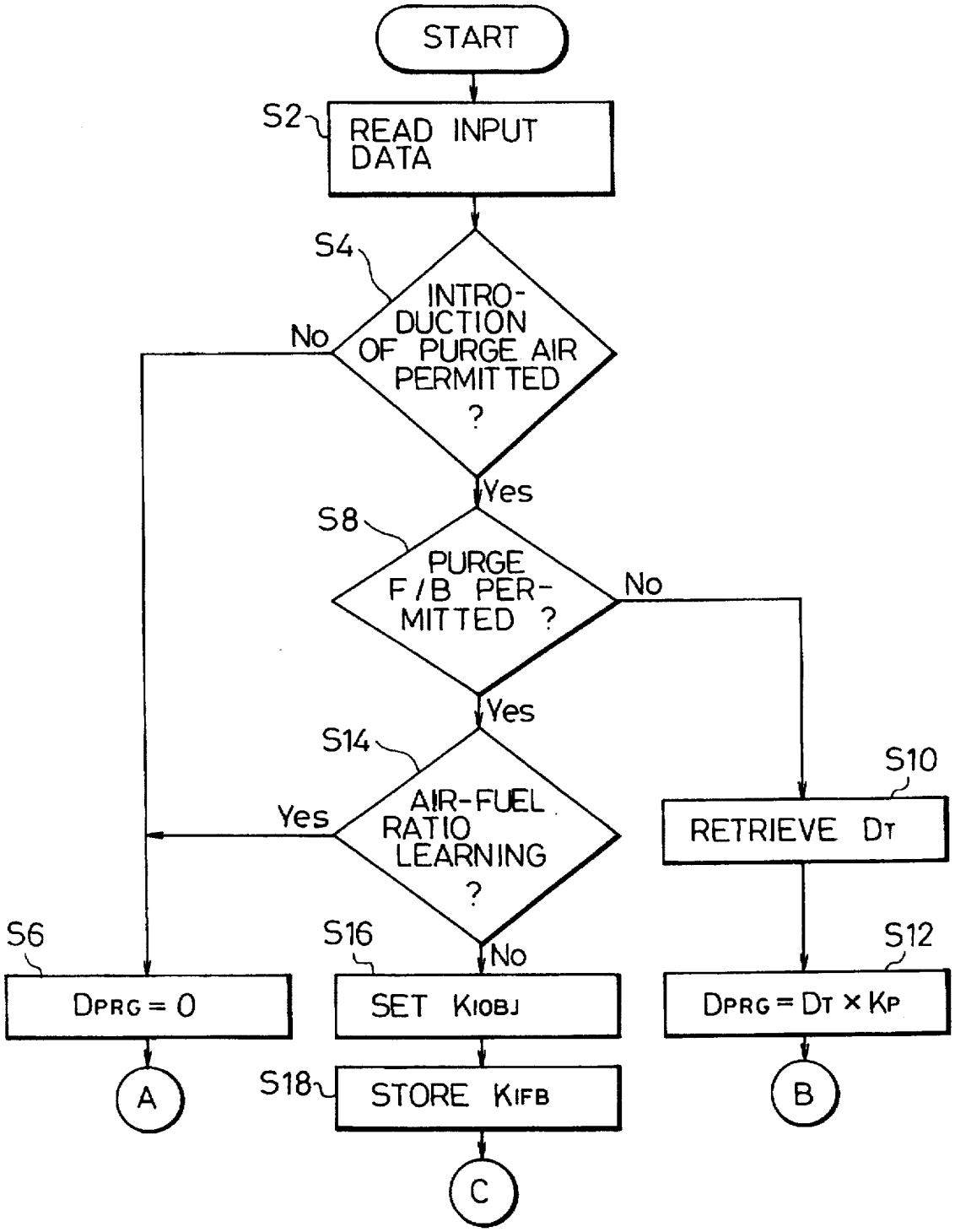
FIG. 3 is a flowchart showing part of a purge control subroutine executed by the electronic control unit.
Figure 4:
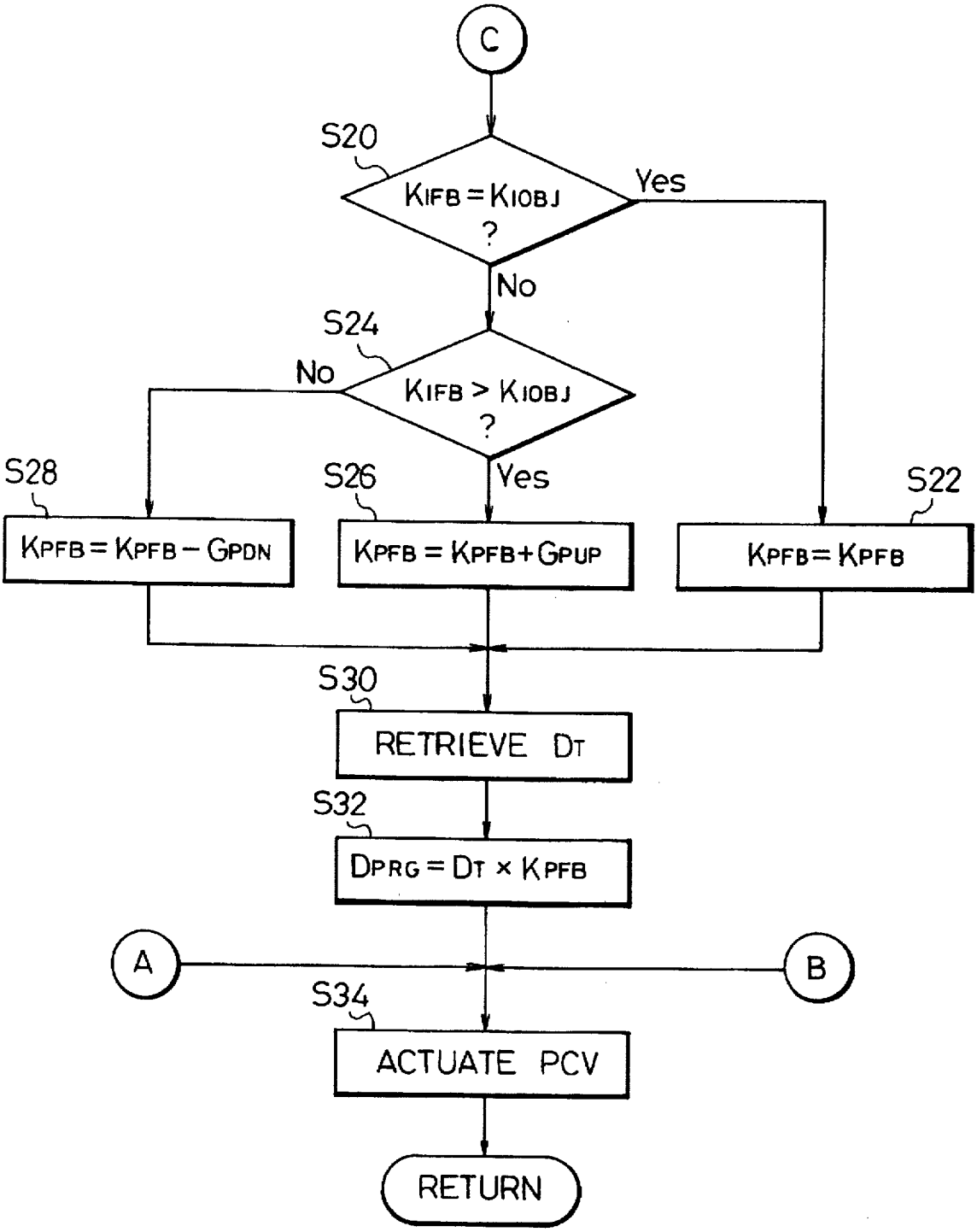
FIG. 4 is a flowchart showing the remaining part of the purge control subroutine.

When the ignition key is turned on by the driver and thus the engine 1 is started, the ECU 50 starts to execute a purge control subroutine shown in FIGS. 3 and 4. This subroutine is repeatedly executed at predetermined control intervals.

In the subroutine, the ECU 50 first loads input data from the individual sensors into RAM, in Step S2 of FIG. 3, and then determines whether the current engine operating state fulfills a condition (purge introduction condition) for carrying out purge air introduction, in Step S4. The purge introduction condition is fulfilled, for example, when all of the following four requirements are simultaneously satisfied: a first requirement that a predetermined time Ts (in this embodiment, 6 seconds) has elapsed from the start of the engine, a second requirement that the $O_2$ sensor 22 is activated, a third requirement that the water temperature $W_T$ is higher than or equal to a predetermined value $W_{Ts}$, and a fourth requirement that the volumetric efficiency $E_v$ is greater than or equal to a predetermined value $E_{vs}$.

If the purge introduction condition is not fulfilled and thus the decision in Step S4 is negative (No), a driving duty factor $D_{PRG}$ for the purge control valve (PCV) 46 is set to "0", in Step S6.

On the other hand, if the purge introduction condition is fulfilled and the decision in Step S4 is Yes, the ECU 50 then determines in Step S8 whether a condition (purge F/B condition) for carrying out purge air feedback control is fulfilled.

The purge F/B condition is fulfilled when all of the following three requirements are simultaneously satisfied: a first requirement that the engine 1 is operated in air-fuel ratio feedback mode, a second requirement that the atmospheric pressure $P_a$ is higher than or equal to a predetermined value $P_{as}$, and a third requirement that the intake air temperature $T_a$ is higher than or equal to a predetermined value $T_{as}$.

If the purge F/B condition is not fulfilled and thus the decision in Step S8 is No, the ECU 50 retrieves a basic duty factor $D_T$ from a map shown in FIG. 5, based on the engine rotational speed $N_e$ and the volumetric efficiency $E_v$, in Step S10, and then calculates a driving duty factor $D_{PRG}$ of the PCV 46 according to the equation below, in Step S12.

$$D_{PRG}=D_T \times K_P$$

where $K_P$ represents a predetermined correction coefficient suitably set according to the type of automobile, kind of engine 1, etc.

If the purge F/B condition is fulfilled and the decision in Step S8 is Yes, the ECU 50 determines in Step S14 whether the learning control of air-fuel ratio is under execution. If the decision in this step is Yes, the driving duty factor $D_{PRG}$ of the PCV 46 is set to "0", in Step S6. This is because, if purge air is introduced during the learning control, the air-fuel mixture becomes enriched by the evaporative fuel gas, making it difficult to perform the learning of air-fuel ratio with accuracy.

If the decision in Step S14 is No, the ECU 50 sets a target value $K_{IOBJ}$ (in this embodiment, fixed value 0.9) of the air-fuel ratio feedback correction coefficient $K_{IFB}$ to be applied during introduction of the purge air, in Step S16.

Also, the ECU 50 calculates an air-fuel ratio feedback correction coefficient $K_{IFB}$ in an air-fuel ratio feedback control subroutine, which is not described in detail here. The calculated value $K_{IFB}$ increases or decreases in accordance with the detected value of the $O_2$ sensor 22, and is approximately 1.0 if the air-fuel ratio is controlled to a stoichiometric air-fuel ratio while no purge air is introduced.

Then, in Step S18, the ECU 50 stores the air-fuel ratio feedback correction coefficient $K_{IFB}$, calculated in the air-fuel ratio feedback control subroutine, in the RAM incorporated therein, and determines in Step S20 of FIG. 4 whether this correction coefficient $K_{IFB}$ is equal to the target value $K_{IOBJ}$.

If the ratio of the quantity of fuel injected from the fuel injection valves 3 to the quantity of evaporative fuel gas (fuel component) purged into the engine 1 from the canister 41 is 9:1, then the air-fuel ratio feedback correction coefficient $K_{IFB}$ equals the target value 0.9. In this case, the decision in Step S20 becomes Yes, and the purge feedback correction coefficient $K_{PFB}$ is set to a value equal to that of the preceding cycle, in Step S22. The initial value and maximum value of the correction coefficient $K_{PFB}$ are, for example, 1.0.

On the other hand, if the decision in Step S20 is No, a further determination is made in Step S24 as to whether the air-fuel ratio feedback correction coefficient $K_{IFB}$ is greater than the target value $K_{IOBJ}$for the purge air introduction period. If the decision in this step is Yes, that is, if the quantity of evaporative fuel gas introduced is too small, the predetermined incremental gain $G_{PUP}$ (e.g., 0.01) is added to the purge feedback correction coefficient $K_{PFB}$, in Step S26, thereby updating the correction coefficient $K_{PFB}$. Conversely, if the decision in Step S20 is No, that is, if the quantity of evaporative fuel gas introduced is too large, the predetermined decremental gain $G_{PDN}$ (e.g., 0.01) is subtracted from the purge feedback correction coefficient $K_{PFB}$, in Step S28, thus updating the correction coefficient $K_{PFB}$.

Subsequently, in Step S30, the ECU 50 retrieves a basic duty factor $D_T$ from the map of FIG. 5, based on the engine rotational speed $N_e$ and the volumetric efficiency $E_v$, and calculates a driving duty factor $D_{PRG}$ of the PCV 46, in Step S32, according to the following equation:

$$D_{PRG}=D_T \times K_{PFB}$$

Finally, in Step S34, the ECU 50 actuates the PCV 46 with the driving duty factor $D_{PRG}$ calculated in Step S6, S12 or S32, whereupon the execution of the purge control subroutine for the present control cycle ends. Upon lapse of a control interval after completion of the subroutine, the purge control subroutine is again executed from Step S2.

In this embodiment, the control procedure described above is employed, and therefore, the driving duty factor $D_{PRG}$ of the PCV 46 is increased or decreased at an identical ratio, regardless of the magnitude of the basic duty factor $D_T$. Consequently, also in a transitional operating condition in which the intake air quantity suddenly increases or decreases, purge air is promptly introduced such that the ratio (in this embodiment, 10%) of the quantity of evaporative fuel gas to the quantity of injected fuel is constant, whereby the air-fuel ratio is prevented from becoming overrich or overlean due to deficiency or excess in the quantity of purge air introduced.

A fuel evaporative emission suppressing apparatus according to a second embodiment of the present invention will be now described.

In the first embodiment, the purge control variable $D_{PRG}$ is obtained by multiplying the basic purge control variable $D_T$ by the purge correction coefficient $K_{PFB}$, but in the second embodiment, the purge control variable $D_T$ is obtained based on a purge correction variable $D_{PUP}$ or $D_{PDN}$, which is variably set in accordance with the engine operating state, and the basic purge control variable $D_T$. The apparatus of this embodiment is identical with that of the first embodiment in the other respects.

In connection with the above point of difference, the electronic control unit (ECU) 50 of this embodiment includes purge correction variable setting means, not shown, in place of the purge correction coefficient setting means 50*d* shown in FIG. 2. The purge correction variable setting means compares the air-fuel ratio correction coefficient $K_{IFB}$, which is set by the fuel supply means 50*a* (FIG. 2) during introduction of purge air, with the target air-fuel ratio correction coefficient $K_{IOBJ}$ for purge air introduction period, which is set by the target air-fuel ratio correction coefficient setting means 50*c* (FIG. 2), and sets the purge correction variable $D_{PUP}$ or $D_{PDN}$ based on the result of the comparison and the engine operating state (e.g., engine rotational speed and volumetric efficiency) detected by the operating state detecting means 50*b* (FIG. 2). The purge control means (corresponding to element 50*f* in FIG. 2) of this embodiment sets the purge control variable $D_T$ (corresponding to $D_{PRG}$ in FIG. 2) based on the purge correction variable $D_{PUP}$ or $D_{PDN}$ and the basic purge control variable $D_T$.

Figure 6:
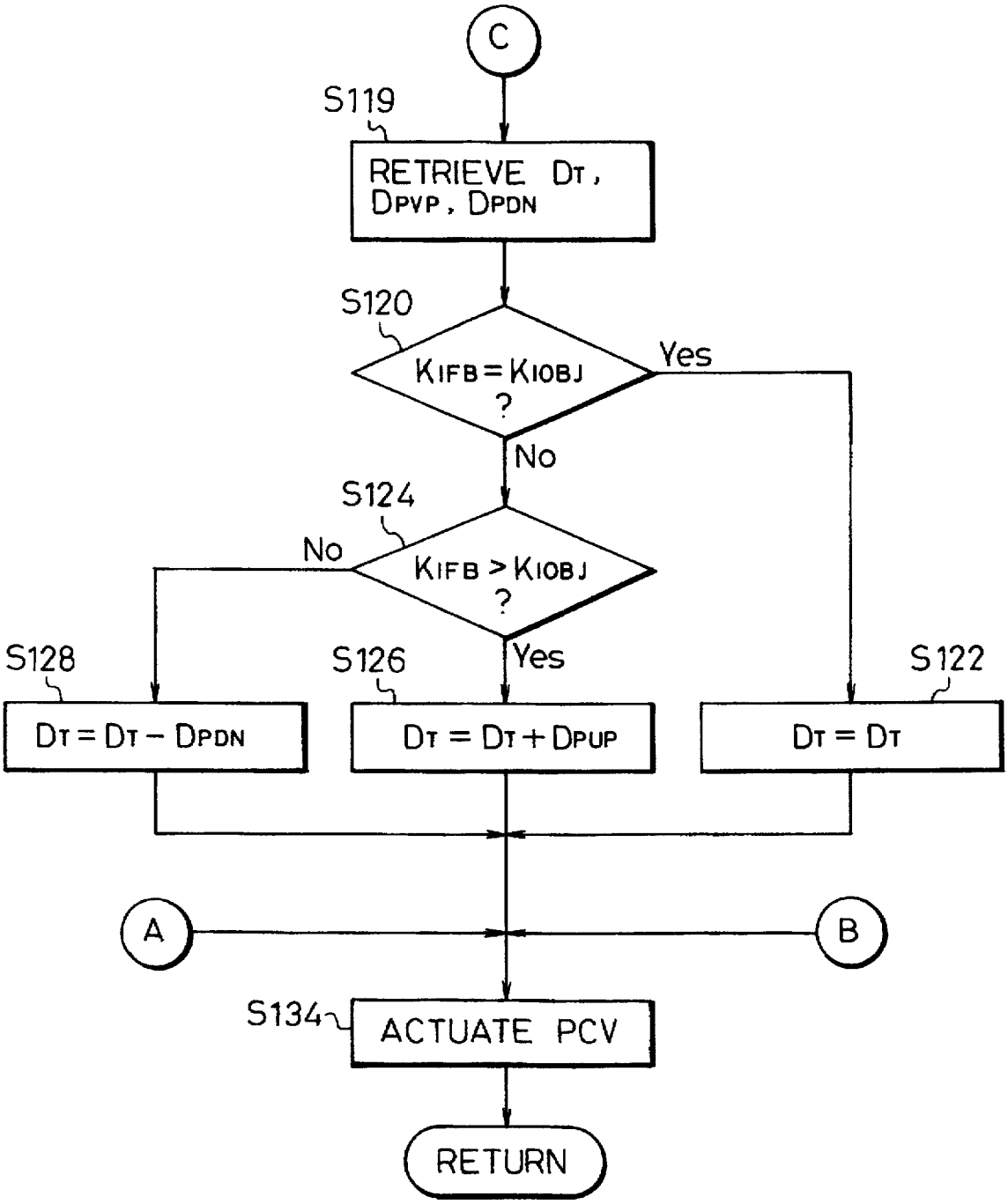
FIG. 6 is a flowchart showing part of a purge control subroutine executed by an electronic control unit of a fuel evaporative emission suppressing apparatus according to a second embodiment of the invention.

The ECU 50 of this embodiment executes a purge control subroutine shown in FIGS. 3 and 6. A series of steps shown in FIG. 6 is similar to that shown in FIG. 4.

In this subroutine, the ECU 50 reads input data from the various sensors (Step S2 in FIG. 3), and determines whether the present engine operating state fulfills the purge introduction condition (Step S4). If the decision in this step is No, the driving duty factor $D_{PRG}$ of the PCV 46 is set to "0 " (Step S6). On the other hand, if the decision in Step S4 is Yes, it is determined whether the purge F/B condition is fulfilled (Step S8).

Figure 5:
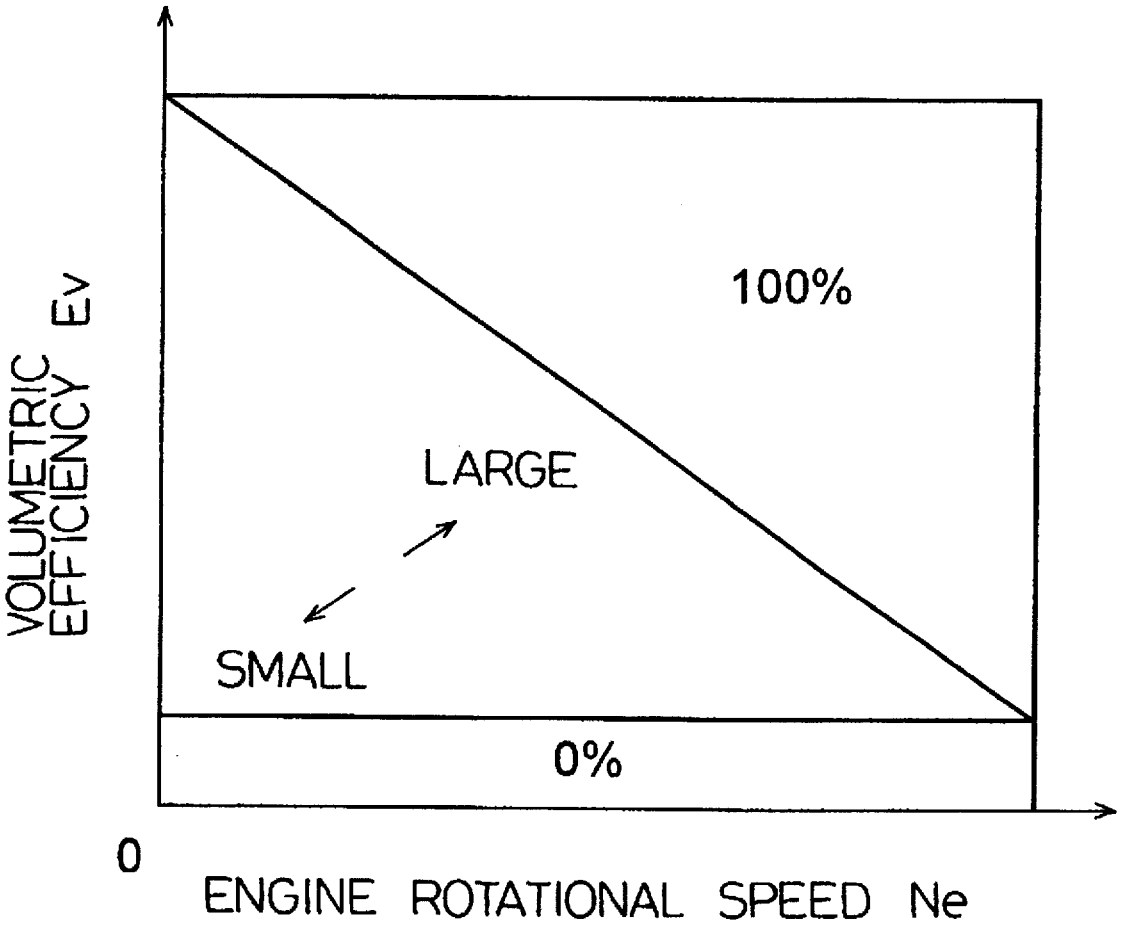
FIG. 5 is a graph showing an example of a map for determining a basic duty factor $D_T$ of a purge control valve.

If the decision in Step S8 is No, a basic duty factor $D_T$ is retrieved based on the engine rotational speed $N_e$ and the volumetric efficiency $E_v$, from the map shown in FIG. 5 (Step S10), and the driving duty factor $D_{PRG}$ of the PCV 46 is calculated (Step S12). On the other hand, if the decision in Step S8 is Yes, it is determined whether the air-fuel ratio learning control is under execution (Step S14). If the decision in this step is Yes, the driving duty factor $D_{PRG}$ of the PCV 46 is set to "0 " in Step S6.

If the decision in Step S14 is No, the target value $K_{IOBJ}$ (in this embodiment, fixed value "0.9") of the air-fuel ratio feedback correction coefficient $K_{IFB}$ for purge air introduction period is set (Step S16), and the air-fuel ratio feedback correction coefficient $K_{IFB}$ calculated in the air-fuel ratio feedback control subroutine is stored (Step S18).

The control flow then proceeds to Step S119 in FIG. 6, wherein a basic purge control variable $D_T$ and purge correction variables $D_{PUP}$ and $D_{PDN}$ are retrieved from maps, not shown, based on the engine operating state, for example, the engine rotational speed $N_e$ and the volumetric efficiency $E_v$.

Then, in Step S120, it is determined whether the correction coefficient $K_{IFB}$ is equal to the target value $K_{IOBJ}$. If Yes in Step S120, the basic purge control variable $D_T$ is set as the purge control variable $D_T$ (Step S122).

On the other hand, if the decision in Step S120 is No, it is determined whether the air-fuel ratio feedback correction coefficient $K_{IFB}$ is greater than the target value $K_{IOBJ}$ for purge air introduction period (Step S124). If the decision in this step is Yes, the purge correction variable $D_{PUP}$ is added to the basic purge control variable $D_T$ to obtain the purge control variable (driving duty factor of the PCV 46) $D_T$ (Step S126). If, on the other hand, the decision in Step S124 is No, the purge control variable $D_T$ is obtained by subtracting the purge correction variable $D_{PDN}$ from the basic purge control variable $D_T$ (Step S128).

In the next Step S134, the PCV 46 is actuated with the driving duty factor $D_{PRG}$ or $D_T$ calculated in Step S6, S12, S122, S126 or S128. Then, execution of the purge control subroutine for the present control cycle ends.

As described above, in this embodiment, the purge control variable $D_T$ is obtained based on the purge correction variable $D_{PUP}$ or $D_{PDN}$ and the basic purge control variable $D_T$; therefore, not only the response is improved through the setting of the basic purge control variable in accordance with the engine operating state but also the air-fuel ratio is optimized through the variable setting of the purge correction variable. Consequently, even in a transitional engine operating condition, purge air is introduced promptly so that the ratio of the quantity of introduced evaporative fuel gas to the quantity of supplied fuel may be constant, thus optimizing the quantity of purge air introduced. It is, therefore, possible to prevent the air-fuel ratio from becoming excessively rich or lean due to deficiency or excess of introduced purge air.

A fuel evaporative emission suppressing apparatus according to a third embodiment of the present invention will be now described.

In this embodiment, the purge control variable $D_T$ is obtained based on a purge correction variable $D_{T\alpha}$ or $D_{T\beta}$, which is obtained by multiplying the basic purge control variable $D_T$ by a purge correction coefficient $\alpha$ or $\beta$, and the basic purge control variable $D_T$. In the other respects, the apparatus of this embodiment is identical with that of the first embodiment.

In connection with the above feature, the electronic control unit (ECU) 50 of this embodiment includes purge control means (not shown) corresponding to element 50f shown in FIG. 2. The purge control means of this embodiment obtains the purge control variable $D_T$ based on the purge correction variable $D_{T\alpha}$ or $D_{T\beta}$, which is obtained by multiplying the basic purge control variable $D_T$ by the purge correction coefficient $\alpha$ or $\beta$, and the basic purge control variable $D_T$.

Figure 7:
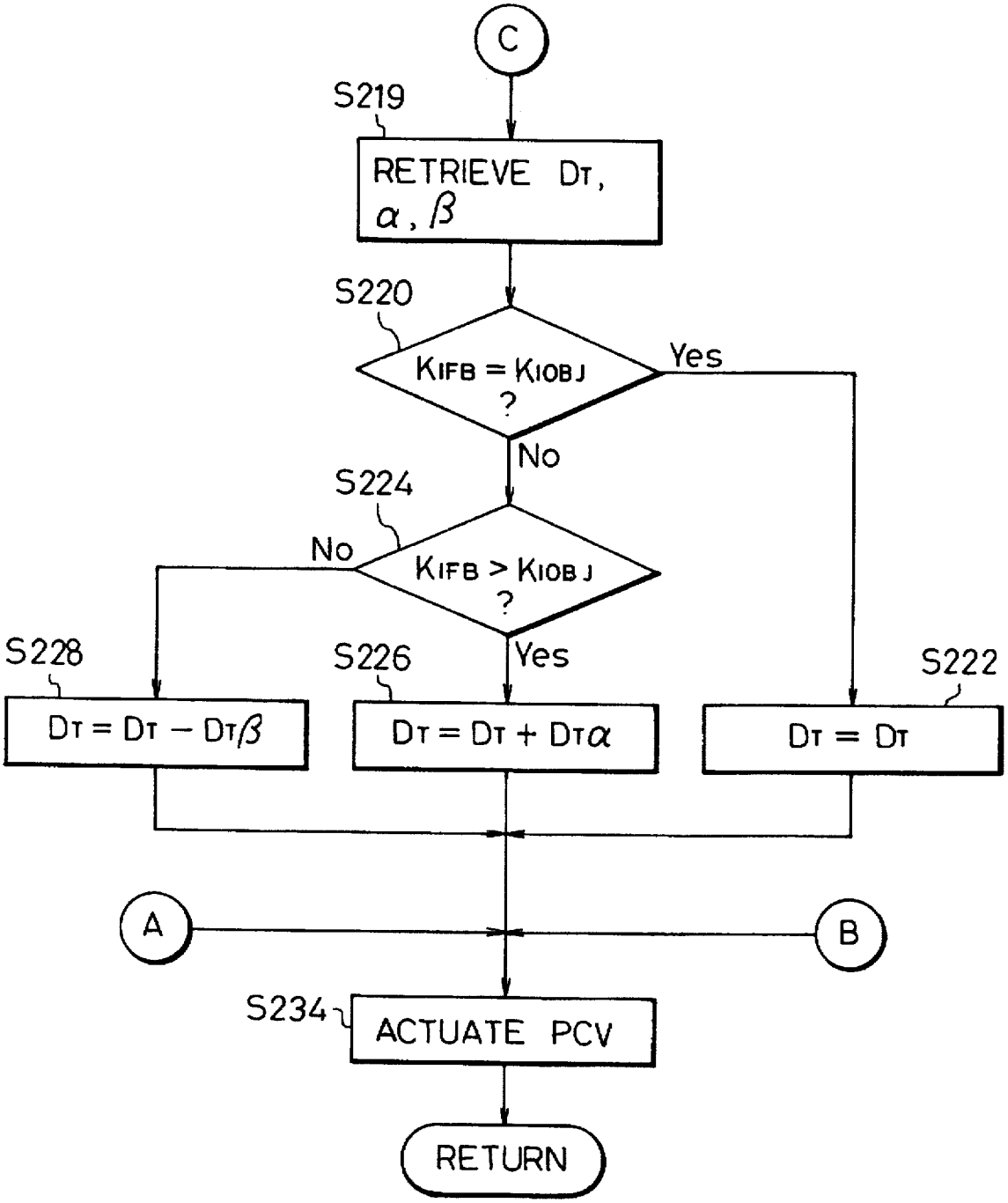
FIG. 7 is a flowchart showing part of a purge control subroutine executed by an electronic control unit of a fuel evaporative emission suppressing apparatus according to a third embodiment of the invention.

The ECU 50 of this embodiment executes a purge control subroutine shown in FIGS. 3 and 7. A series of steps shown in FIG. 7 is similar to that shown in FIG. 4 or 6.

In this subroutine, related ones of steps from among the sequence of Steps S2, S4, S6, S8, S10, S12, S14, S16 and S18 shown in FIG. 3 are sequentially executed. Since these steps are already explained, description of the steps is omitted here.

In Step S219 in FIG. 7 which follows Step S18, a basic purge control variable $D_T$ and a purge correction coefficient $\alpha$ or $\beta$ are retrieved from maps, not shown, based on the engine operating state, for example, the engine rotational speed $N_e$ and the volumetric efficiency $E_v$.

In the next Step S220, it is determined whether the correction coefficient $K_{IFB}$ is equal to the target value $K_{IOBJ}$. If Yes in Step S220, the basic purge control variable $D_T$ is set as the purge control variable $D_T$ (Step S222).

On the other hand, if the decision in Step S220 is No, it is determined whether the air-fuel ratio feedback correction coefficient $K_{IFB}$ is greater than the target value $K_{IOBJ}$ for purge air introduction period (Step S224). If the decision in this step is Yes, a purge correction variable $D_{T\alpha}$, which is obtained by multiplying the basic purge control variable $D_T$ by the purge correction coefficient $\alpha$, is added to the basic purge control variable $D_T$ to obtain the purge control variable (driving duty factor of the PCV 46) $D_T$ (Step S226). On the other hand, if the decision in Step S224 is No, a purge correction variable $D_{T\beta}$, which is obtained by multiplying the basic purge control variable $D_T$ by the purge correction coefficient $\beta$, is subtracted from the basic purge control variable $D_T$ to obtain the purge control variable $D_T$ (Step S228).

In the next Step S234, the PCV 46 is actuated with the driving duty factor $D_{PRG}$ or $D_T$ calculated in Step S6, S12, S222, S226 or S228.

As described above, in this embodiment, the purge control variable $D_T$ is obtained based on the purge correction variable $D_{T\alpha}$ or $D_{T\beta}$, which is obtained by multiplying the basic purge control variable $D_T$ by the purge correction coefficient $\alpha$ or $\beta$, and the basic purge control variable $D_T$; therefore, both the improvement of the response through the setting of the basic purge control variable in accordance with the engine operating state and the optimization of the air-fuel ratio through the setting of the purge correction variable can be attained simultaneously. Consequently, even in a transitional engine operating condition, purge air is introduced promptly so that the ratio of the quantity of introduced evaporative fuel gas to the quantity of supplied fuel may be constant, thereby optimizing the quantity of purge air introduced.

The present invention is not limited to the first through third embodiments described above and may be modified in various ways.

For example, the first embodiment wherein the purge control variable is obtained by multiplying the basic purge control variable by the purge correction coefficient, which is set in accordance with the result of the comparison between the target air-fuel ratio correction coefficient and the air-fuel ratio correction coefficient set during introduction of purge air may be modified in the manner described below. First, a purge correction variable is set in accordance with the comparison result. Then, in response to a change in the engine operating state (e.g., the engine rotational speed and the volumetric efficiency), the purge correction variable is modified so that fluctuation of the air-fuel ratio may be suppressed. Further, the purge control variable is obtained based on the thus-modified purge correction variable and the basic purge control variable. In this case, the electronic control unit 50 can be modified so as to achieve the function of the means for setting the purge correction variable, the function of the means for modifying the purge correction variable, and the function of the purge control means for obtaining the purge control variable.

Although in the foregoing embodiments, the target value $K_{IOBJ}$ for purge air introduction period is a fixed value, it may be suitably set in accordance with the engine operating state (e.g., engine rotational speed and volumetric efficiency) etc.

Further, the present invention may be applied to a fuel evaporative emission suppressing apparatus installed in an engine other than the in-line four-cylinder gasoline engine. In the foregoing embodiments, the present invention is applied to an apparatus installed in an engine in which the air-fuel ratio of a mixture is controlled so as to be close to the stoichiometric air-fuel ratio by using an $O_2$ sensor, but it may be applied to an apparatus installed in a so-called lean burn engine in which the air-fuel ratio is controlled to a predetermined lean air-fuel ratio by using a linear air-fuel ratio sensor or the like. Alternatively, the invention may be applied to an apparatus installed in an engine in which the fuel supply is carried out by an electronic controlled carburetor or the like instead of the fuel injection apparatus.

Furthermore, the purge control procedure may be modified in specific applications.

We claim:

1. A fuel evaporative emission suppressing apparatus for an internal combustion engine whose operation is controlled by fuel supply control means which uses an air-fuel ratio correction coefficient to set a quantity of fuel to be supplied from fuel supply means to the internal combustion engine during air-fuel ratio feedback control in which an air-fuel ratio of a mixture supplied to the internal combustion engine is controlled to a target air-fuel ratio, the apparatus having adsorbing means for adsorbing evaporative fuel gas introduced from a fuel supply system and purge adjusting means for controlling a quantity of introduction of purge air, which contains outside air and evaporative fuel gas separated from the adsorbing means, into an intake passage of the internal combustion engine, comprising:

operating state detecting means for detecting an operating state of the internal combustion engine;

target air-fuel ratio correction coefficient setting means for setting a target air-fuel ratio correction coefficient for purge air introduction period;

purge correction variable setting means for comparing the target air-fuel ratio correction coefficient with an air-fuel ratio correction coefficient which is set by the fuel supply control means during introduction of purge air, and for variably setting a purge correction variable in accordance with a comparison result and the engine operating state detected by said operating state detecting means;

basic purge control variable setting means for setting a basic purge control variable in accordance with the engine operating state detected by said operating state detecting means; and purge control means for obtaining a purge control variable based on the purge correction variable and the basic purge control variable, and for controlling operation of the purge adjusting means in accordance with the purge control variable.

2. A fuel evaporative emission suppressing apparatus for an internal combustion engine whose operation is controlled by fuel supply control means which uses an air-fuel ratio correction coefficient to set a quantity of fuel to be supplied from fuel supply means to the internal combustion engine during air-fuel ratio feedback control in which an air-fuel ratio of a mixture supplied to the internal combustion engine is controlled to a target air-fuel ratio, the apparatus having adsorbing means for adsorbing evaporative fuel gas introduced from a fuel supply system and purge adjusting means for controlling a quantity of introduction of purge air, which contains outside air and evaporative fuel gas separated from the adsorbing means, into an intake passage of the internal combustion engine, comprising:

operating state detecting means for detecting an operating state of the internal combustion engine;

target air-fuel ratio correction coefficient setting means for setting a target air-fuel ratio correction coefficient for purge air introduction period;

purge correction variable setting means for comparing the target air-fuel ratio correction coefficient with an air-fuel ratio correction coefficient which is set by the fuel supply control means during introduction of purge air, and for setting a purge correction variable in accordance with a comparison result;

purge correction variable modifying means for modifying the purge correction variable in accordance with a change in the engine operating state in such a manner that fluctuation of the air-fuel ratio is suppressed;

basic purge control variable setting means for setting a basic purge control variable in accordance with the engine operating state detected by said operating state detecting means; and purge control means for obtaining a purge control variable based on the purge correction variable modified by said purge correction variable modifying means and the basic purge control variable, and for controlling operation of the purge adjusting means in accordance with the purge control variable.

3. A fuel evaporative emission suppressing apparatus for an internal combustion engine whose operation is controlled by fuel supply control means which uses an air-fuel ratio correction coefficient to set a quantity of fuel to be supplied from fuel supply means to the internal combustion engine during air-fuel ratio feedback control in which an air-fuel ratio of a mixture supplied to the internal combustion engine is controlled to a target air-fuel ratio, the apparatus having adsorbing means for adsorbing evaporative fuel gas introduced from a fuel supply system and purge adjusting means for controlling a quantity of introduction of purge air, which contains outside air and evaporative fuel gas separated from the adsorbing means, into an intake passage of the internal combustion engine, comprising:

operating state detecting means for detecting an operating state of the internal combustion engine;

target air-fuel ratio correction coefficient setting means for setting a target air-fuel ratio correction coefficient for purge air introduction period;

purge correction coefficient setting means for comparing the target air-fuel ratio correction coefficient with an air-fuel ratio correction coefficient which is set by the fuel supply control means during introduction of purge air, and for setting a purge correction coefficient in accordance with a comparison result;

basic purge control variable setting means for setting a basic purge control variable in accordance with the engine operating state detected by said operating state detecting means; and purge control means for obtaining a purge control variable by multiplying the basic purge control variable by the purge correction coefficient, and for controlling operation of the purge adjusting means in accordance with the purge control variable.

4. A fuel evaporative emission suppressing apparatus for an internal combustion engine whose operation is controlled by fuel supply control means which uses an air-fuel ratio correction coefficient to set a quantity of fuel to be supplied from fuel supply means to the internal combustion engine during air-fuel ratio feedback control in which an air-fuel ratio of a mixture supplied to the internal combustion engine is controlled to a target air-fuel ratio, the apparatus having adsorbing means for adsorbing evaporative fuel gas introduced from a fuel supply system and purge adjusting means for controlling a quantity of introduction of purge air, which contains outside air and evaporative fuel gas separated from the adsorbing means, into an intake passage of the internal combustion engine, comprising:

operating state detecting means for detecting an operating state of the internal combustion engine;

target air-fuel ratio correction coefficient setting means for setting a target air-fuel ratio correction coefficient for purge air introduction period;

purge correction coefficient setting means for comparing the target air-fuel ratio correction coefficient with an air-fuel ratio correction coefficient which is set by the fuel supply control means during introduction of purge air, and for setting a purge correction coefficient in accordance with a comparison result;

basic purge control variable setting means for setting a basic purge control variable in accordance with the engine operating state detected by said operating state detecting means; and purge control means for obtaining a purge control variable based on a purge correction variable, which is obtained by multiplying the basic purge control variable by the purge correction coefficient, and the basic purge control variable, and for controlling operation of the purge adjusting means in accordance with the purge control variable.

5. The fuel evaporative emission suppressing apparatus according to any one of claims 1 through 4, wherein said target air-fuel ratio correction coefficient setting means sets the target air-fuel ratio correction coefficient for purge air introduction period in accordance with the operating state of the internal combustion engine detected by said operating state detecting means.

6. The fuel evaporative emission suppressing apparatus according to any one of claims 1 through 4, wherein the fuel supply control means sets the air-fuel ratio correction coefficient at predetermined intervals while permitting updating of the air-fuel ratio correction coefficient, and the purge adjusting means is operated at intervals identical with the predetermined intervals.

7. The fuel evaporative emission suppressing apparatus according to any one of claims 1 through 4, wherein the fuel evaporative emission suppressing apparatus comprises purge passage forming means having a single purge passage through which the adsorbing means is communicated to the intake passage of the internal combustion engine, and the purge adjusting means is arranged in the single purge passage.

8. The fuel evaporative emission suppressing apparatus according to claim 2, wherein:

said target air-fuel ratio correction coefficient setting means sets the target air-fuel ratio correction coefficient for purge air introduction period to a value such that a quantity of fuel supplied from the fuel supply means which corresponds to the target air-fuel ratio correction coefficient is smaller than a quantity of supplied fuel corresponding to an air-fuel ratio correction coefficient which is set during a non-purge air introduction period;

said purge correction variable setting means decreases the purge correction variable by a first predetermined gain when the air-fuel ratio correction coefficient is set to a value such that the quantity of supplied fuel is even smaller than the quantity of supplied fuel corresponding to the target air-fuel ratio correction coefficient; and said purge correction variable setting means increases the purge correction variable by a second predetermined gain when the air-fuel ratio correction coefficient is set to a value such that the quantity of supplied fuel is larger than the quantity of supplied fuel corresponding to the target air-fuel ratio correction coefficient.

9. The fuel evaporative emission suppressing apparatus according to claim 8, wherein said purge correction variable setting means leaves the purge correction variable unchanged when an air-fuel ratio correction coefficient set during introduction of purge air is equal to the target air-fuel ratio correction coefficient.

10. The fuel evaporative emission suppressing apparatus according to claim 3 or 4, wherein:

said target air-fuel ratio correction coefficient setting means sets the target air-fuel ratio correction coefficient for purge air introduction period to a value such that a quantity of fuel supplied from the fuel supply means which corresponds to the target air-fuel ratio correction coefficient is smaller than a quantity of supplied fuel corresponding to an air-fuel ratio correction coefficient which is set during a non-purge air introduction period;

said purge correction coefficient setting means decreases the purge correction coefficient by a first predetermined gain when the air-fuel ratio correction coefficient is set to a value such that the quantity of supplied fuel is even smaller than the quantity of supplied fuel corresponding to the target air-fuel ratio correction coefficient; and said purge correction coefficient setting means increases the purge correction coefficient by a second predetermined gain when the air-fuel ratio correction coefficient is set to a value such that the quantity of supplied fuel is larger than the quantity of supplied fuel corresponding to the target air-fuel ratio correction coefficient.

11. The fuel evaporative emission suppressing apparatus according to claim 10, wherein said purge correction coefficient setting means leaves the purge correction coefficient unchanged when an air-fuel ratio correction coefficient set during introduction of purge air is equal to the target air-fuel ratio correction coefficient.

12. A fuel evaporative emission suppressing method for an internal combustion engine, comprising:

detecting an operating condition of said internal combustion engine;

setting an air-fuel ratio correction coefficient to determine an amount of fuel supplied to said internal combustion engine during an air-fuel ratio feedback control in which an air-fuel ratio of a mixture supplied to said internal combustion engine is controlled to a target air-fuel ratio;

setting a target air-fuel ratio correction coefficient for purge air introduction period;

comparing said air-fuel ratio correction coefficient and said target air-fuel ratio correction coefficient to determine a purge correction coefficient based on the compared result;

determining a purge control variable based at least on said determined purge correction coefficient; and controlling a purge adjusting unit based on said determined purge control variable.

13. The method according to claim 12, further comprising:

setting a basic purge control variable based on said detected operating condition of said internal combustion engine, wherein said purge control variable is based on said determined purge correction coefficient and said basic purge control variable.

* * * * *